US005631564A

United States Patent [19]

Heining

[11] Patent Number: 5,631,564

[45] Date of Patent: May 20, 1997

[54] METHOD AND APPARATUS FOR MONITORING THE IGNITION DEVICE OF AN INTERNAL COMBUSTION ENGINE

[75] Inventor: Jörn Heining, Regensburg, Germany

[73] Assignee: Siemens Aktiengesellschaft, Munich, Germany

[21] Appl. No.: 404,367

[22] Filed: Mar. 15, 1995

[30] Foreign Application Priority Data

Mar. 18, 1994 [EP] European Pat. Off. ..... 94104420

[51] Int. Cl.[6] ..... F02P 17/00

[52] U.S. Cl. ..... 324/380; 324/378

[58] Field of Search ..... 324/380, 381, 324/382, 383, 384, 378, 402

[56] References Cited

U.S. PATENT DOCUMENTS

| | | | |
|---|---|---|---|
| 4,447,880 | 5/1984 | Kasai et al. | 324/380 |
| 5,446,385 | 8/1995 | Kugler et al. | 324/380 |
| 5,495,757 | 3/1996 | Atanasyan et al. | 324/380 |

FOREIGN PATENT DOCUMENTS

| | | |
|---|---|---|
| 0373694 | 6/1990 | European Pat. Off. . |
| 0470277 | 2/1992 | European Pat. Off. . |
| 2530987 | 1/1977 | Germany . |
| 2064645 | 6/1981 | United Kingdom . |

OTHER PUBLICATIONS

Patent Abstracts of Japan, vol. 11, No. 261 (P-609) Aug. 25, 1987 & JP-62067473 (OKI) Mar. 27, 1987.

Patent Abstracts of Japan, vol. 17, No. 626 (P-1647) Nov. 18, 1993 & JP-520 3698 (OKI) Aug. 10, 1993.

*Primary Examiner*—Louis M. Arana

*Attorney, Agent, or Firm*—Herbert L. Lerner; Laurence A. Greenberg

[57] ABSTRACT

Secondary current circuits are monitored in an ignition device of an externally ignited internal combustion engine having at least two primary current circuits each being closed and opened by one ignition end stage transistor. A base-to-emitter voltage of each ignition end stage transistor is measured and stored in memory with the primary current circuit closed. A comparison value is formed from at least two successive measured values and compared with a limit value. A failure signal is output as a function of the comparison. An apparatus for monitoring the secondary current circuits includes an engine or ignition control unit for making the ignition end stage transistors conducting or nonconducting. The control unit has a measurement input connected to the base terminals of the ignition end stage transistors, a measurement circuit for measuring values of successive base-to-emitter voltages of the ignition end stage transistors, a memory for storing at least two successive measured values, a comparison circuit for forming a comparison value of the stored measured values, and at least one comparator for comparing the comparison value with a predetermined limit value and for outputting a failure signal at an output if the comparison value exceeds or fails to attain the limit value.

10 Claims, 1 Drawing Sheet

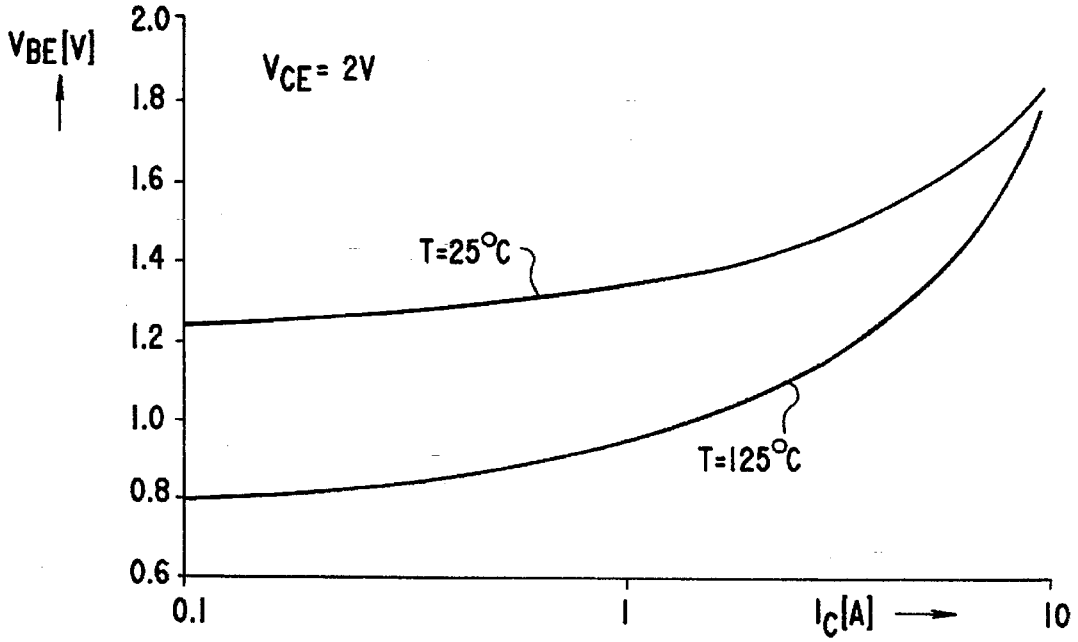
FIG.1
FIG.2
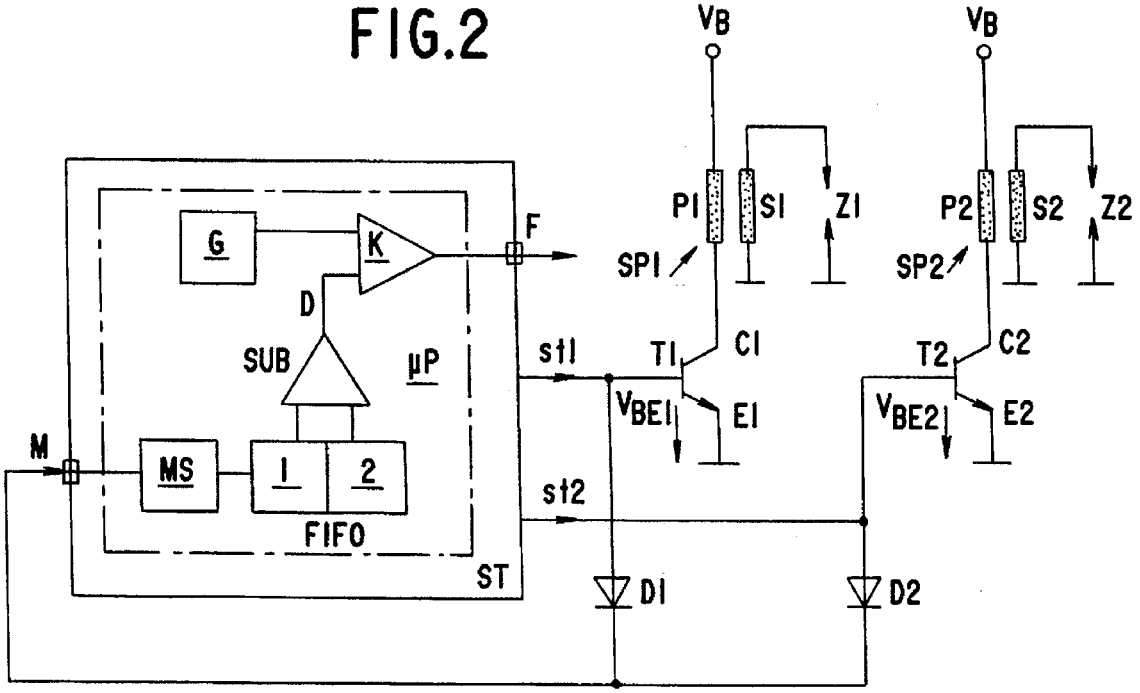

METHOD AND APPARATUS FOR MONITORING THE IGNITION DEVICE OF AN INTERNAL COMBUSTION ENGINE

BACKGROUND OF THE INVENTION

Field of the Invention

The invention relates to a method for monitoring secondary current circuits in an ignition vice of an external ignited internal combustion engine, having at least to primary current circuits each being closed or opened by means of one ignition end stage transistor. The invention also relates to an apparatus for performing the method.

Electric ignition devices for externally ignited internal combustion engines as a rule use one or more ignition coils as energy reservoirs for ignition sparks in order to ignite a fuel-air mixture in individual cylinders. During a certain closing time prior to the tripping of ignition, a primary winding of the associated ignition coil experiences a flow through it of an increasing current, and in the process stores energy in itself. Turning off the primary current trips an ignition, in that the stored energy flows through the secondary winding of the ignition coil into the spark plug, where it is broken down into the ignition spark.

If there is an interruption in the secondary current circuit of the ignition coil that cannot be bridged by the high voltage, then the energy stored in the ignition coil, after the opening of the primary current circuit in the ignition end stage transistor, is converted into heat once that transistor has been made conducting by means of its protective wiring, as a consequence of the excess voltage. Heretofore, monitoring the secondary current circuits in simple engine or ignition control devices has been too complicated and expensive and was therefore not done. In order to avoid overheating of the ignition end stage transistors, a heat dissipation line of the ignition end stage is made sufficiently oversized to avoid damage to the end stage in the event of a failure.

An interruption of the secondary current circuit cannot be detected by measuring the current or voltage on the primary side of the ignition coil, but it can be detected on the secondary side (from an overly low current or excessively high voltage). However, because of the high voltages involved, making that measurement is complicated and expensive.

Published European Application No. 0 470 277 A1 discloses an ignition device for internal combustion engines in which a sensor is disposed between the ignition coil and ground. The duration and amplitude of the secondary current can be measured by that sensor and evaluated in the microprocessor of the ignition control unit as to whether or not an undesired interruption in the secondary current circuit has occurred.

SUMMARY OF THE INVENTION

It is accordingly an object of the invention to provide a method and an apparatus for monitoring an ignition device of an internal combustion engine, which overcome the hereinafore-mentioned disadvantages of the heretofore-known methods and devices of this general type and which monitor secondary current circuits for interruptions in an ignition device of an externally ignited internal combustion engine so that no measurement of high voltages will be necessary and so that no current consumers that reduce the ignition energy are needed in the secondary current circuits.

With the foregoing and other objects in view there is provided, in accordance with the invention, in a method for monitoring secondary current circuits in an ignition device of an externally ignited internal combustion engine having at least two primary current circuits each being closed and opened by one ignition end stage transistor, the improvement which comprises measuring a base-to-emitter voltage of each ignition end stage transistor and storing the base-to-emitter voltage in memory with the primary current circuit closed; forming a comparison value from at least two successive measured values and comparing the comparison value with a limit value; and outputting a failure signal as a function of the comparison.

In accordance with another mode of the invention, there is provided a method which comprises carrying out the step of measuring the base-to-emitter voltage of each ignition end stage transistor as long as a collector current of the ignition end stage transistor is below a given value or as soon as a collector current of the ignition end stage transistor attains a given value.

In accordance with a further mode of the invention, there is provided a method which comprises initiating the step of measuring the base-to-emitter voltage of one of the ignition end stage transistors at the onset of a control signal for that transistor.

With the objects of the invention in view, there is also provided, in an ignition device of an externally ignited internal combustion engine including at least two primary current circuits each having one ignition end stage transistor with base and emitter terminals; and secondary current circuits, an apparatus for monitoring the secondary current circuits, comprising an engine or ignition control unit for making the ignition end stage transistors conducting or nonconducting, the control unit having a measurement input connected to the base terminals of the ignition end stage transistors; a measurement circuit connected to the measurement input for measuring values of successive base-to-emitter voltages of the ignition end stage transistors; a memory connected to the measurement circuit for storing at least two successive measured values; a comparison circuit connected to the memory for forming a comparison value of the stored measured values; and at least one comparator connected to the comparison circuit for comparing the comparison value with a predetermined limit value and for outputting a failure signal at an output if the comparison value exceeds or fails to attain the limit value.

In accordance with another feature of the invention, there are provided means for decoupling the base terminals of the ignition end stage transistors from one another.

In accordance with a concomitant feature of the invention, the engine or ignition control unit is microprocessor-controlled.

Other features which are considered as characteristic for the invention are set forth in the appended claims.

Although the invention is illustrated and described herein as embodied in a method and an apparatus for monitoring an ignition device of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagram of a base-to-emitter voltage of an ignition end stage transistor, as a function of a collector current and of temperature; and FIG. 2 is a schematic circuit diagram of an ignition device.

DESCRIPTION OF THE PREFERRED EMBODIMENT

The method of the invention is based on the fact that upon an interruption in a secondary current circuit, energy stored in a primary winding of an ignition coil during a closing time is converted into heat, after an opening of a primary current circuit, in the ignition end stage transistor, which becomes conductive again as a result of excess voltages that occur, by means of its conventional protective wiring. As a result, a temperature-dependent base-to-emitter voltage $V_{BE}$ of this transistor decreases.

Referring now to the figures of the drawing in detail and first, particularly, to FIG. 1 thereof, there is seen a diagram showing the base-to-emitter voltage $V_{BE}$ on the ordinate which is plotted against a collector current $I_C$ on the abscissa, with temperature as a parameter for a typical ignition end stage transistor. Although the values for the collector current $I_C$ in this diagram begin at 100 mA, the tendency for $V_{BE}$ to equal $f(I_C)$ as the values of $I_C$ decrease is nevertheless apparent.

When the primary current circuit is turned on, the collector current $I_C$ of a typical ignition end stage transistor rises, for instance within a period of approximately 2 ms, to its command value of 8 A, and the base-to-emitter voltage $V_{BE}$, given a collector current $I_C$ of approximately 100 mA, rises to a value of approximately 1.25 V, at an assumed temperature of 25° C. (or to 1.0 V at 85° C. of operating temperature), or only to 0.8 V at 125° C., as is seen in FIG. 1.

Within a period of approximately 10 μS, the base-to-emitter voltage $V_{BE}$ rises to a value, which can be found by interpolation from FIG. 1, of approximately 0.95 V at 85° C. (the assumed operating temperature). At 25° C., it would be approximately 1.2 V and conversely at 125° C. it would be only about 0.7 V. Within the period of 10 μS, the collector current $I_C$ has risen to approximately 40 mA. The ratio of $V_{BE\ 85°}/V_{BE\ 125°}$ increases as the collector current $I_C$ decreases. It is therefore advisable to make the measurement of the base-to-emitter voltage $V_{BE}$ at a low collector current $I_C$.

The voltage $V_{BE}$ is simple to measure. In order to avoid deviations from one individual transistor to another, it is not the absolute value of the base-to-emitter voltage of an individual transistor but rather a comparison value (quotient, difference) from among the measured values of at least two transistors that is formed and evaluated.

If such a comparison value fails to attain a certain predetermined limit value because of incipient overheating of an ignition end stage transistor, this is a sign of an interruption in the secondary current circuit. A warning signal can be tripped thereupon, or to avoid major damage the affected cylinders or the entire engine can be shut off.

The limit value may be predetermined, or may be determined adaptively from a comparison value ascertained with intact ignition end stage transistors (for instance the first time the engine is turned on), for instance by multiplication by a predetermined factor.

The method according to the invention will be described in further detail in terms of the schematic circuit diagram of FIG. 2 for a microprocessor-controlled ignition device or control unit ST for a non-illustrated externally ignited internal combustion engine. This ignition device has two ignition circuits. Each ignition circuit respectively includes an ignition end stage transistor T1, T2, an ignition coil SP1, SP2 formed of a primary winding P1, P2 and a secondary winding S1, S2, and at least one spark plug Z1, Z2.

A primary current circuit of each ignition circuit leads from a positive pole $V_B$ of a non-illustrated voltage source to a negative pole of the voltage source, by way of the primary winding P1, P2 and the collector-to-emitter path C1, E1; C2, E2 of the ignition end stage transistor T1, T2.

A secondary current circuit of each ignition circuit leads from the negative pole back to the negative pole by way of the secondary winding S1, S2 and the spark plug or spark plugs Z1, Z2.

The ignition circuits are controlled by the engine or ignition control unit ST, which contains a microprocessor μP that uses various non-illustrated input signals to ascertain the closing and ignition angles for the ignition circuits and supplies corresponding control signals to base terminals B1 and B2 of the ignition end stage transistors T1, T2.

The base terminals B1, B2, which are decoupled from one another with diodes D1, D2, are connected to a measurement input M of the control unit ST. Elements which are shown between this measurement input M and a failure output terminal F of the control unit ST in this exemplary embodiment include elements that are usually present but are unused in the microprocessor μP. These are a series circuit of:

- a measuring circuit MS, which at certain times measures analog base-to-emitter voltages $V_{BE1}$ and $V_{BE2}$ present at the measurement input M, converts them into digital values, and if needed also amplifies them;
- a memory region FIFO which is merely described herein as a FIFO (first in, first out) memory or memory register with two memory locations, for the sake of simplicity;
- a subtractor element SUB which has an output that outputs a variable, a comparison value D, which corresponds to an amount of difference between the two values stored in the FIFO memory; and
- a comparator K, which compares this variable D with a predetermined limit value G and outputs an output signal, a failure signal at the output terminal F, if the variable D exceeds or fails to attain this limit value in a predetermined way.

The method and apparatus for monitoring the secondary current circuits function as follows:

With each onset (closing angle) of one of alternatingly periodically appearing control signals stl, st2 for the two ignition end stage transistors T1 T2, the measurement circuit MS is activated, in order to measure the value of the base-to-emitter voltage $V_{BE1}$, $V_{BE2}$ of the ignition end stage transistor T1 or T2, present at the measurement input M of the control unit ST after a program-dictated or circuit-dictated activation delay of approximately 10 μS. This value, as already noted above, amounts to approximately 0.95 V at an operating temperature of 85° C. and a collector current $I_C$ of approximately 40 mA attained after that amount of time.

In the event that there is no program-dictated delay when the base-to-emitter voltage is detected, then such a delay should be provided in order to ensure that this voltage can attain a certain value at the moment of measurement.

The value detected (for instance, $V_{BE1}$) is measured, digitized, and then stored at a location 1 in a memory FIFO that has two memory locations. With the next control signal, the base-to-emitter voltage $V_{BE2}$ is detected, measured, digitized and memorized (again in location 1), whereupon the previously stored value $V_{BE1}$ is shifted forward one location to a location 2, so that both values are now present in the memory.

Each of the two memory locations is connected to one input of the subtractor element SUB, which forms the comparison value D, corresponding to the amount of the difference $V_{BE1}-V_{BE2}$ between the two values stored in the memory FIFO, and outputs this comparison value at its output. After the next control signal, a new value $V_{BE1*}$, is stored at the location 1, the value $V_{BE2}$ is shifted forward to the location 2, and the old value $V_{BE1}$ is shifted out of the memory (cancelled), whereupon the difference $V_{BE2}-V_{BE1*}$ is now formed in the subtractor element SUB, and a corresponding comparison value D is output, and so forth.

The comparison values D that appear at the output of the subtractor element SUB are compared in the following comparator K with a limit value that is either predetermined or adaptively ascertained, for instance fixed to the value of 0.3 V. This comparator K outputs an output signal (failure signal F) if the amount of the variable D exceeds this limit value G. That would, for instance, mean that the ignition end stage transistor T1 has attained a temperature of about 135° C., while the other ignition end stage transistor T2 is at the operating temperature of 85° C., and vice versa.

Instead of the difference, the quotient of the two measurement values can be formed and then each compared, for instance in a window comparator, with one limit value for whether the limit value fails to be attained or is exceeded.

The failure signal F can be used either merely to trip a warning signal, or also to turn off the affected cylinder (ignition and fuel ignition) or the entire engine, in order to avoid major damage.

I claim:

1. In a method for monitoring secondary current circuits in an ignition device of an externally ignited internal combustion engine having at least two primary current circuits each being closed and opened by one ignition end stage transistor, the improvement which comprises:

measuring a value of a base-to-emitter voltage of each ignition end stage transistor when the respective primary current circuit is closed, and storing the measured values in a memory;

forming a comparison value from at least two successive measured values and comparing the comparison value with a limit value; and outputting a failure signal as a function of the comparison.

2. The method according to claim 1, which comprises carrying out the step of measuring the value of the base-to-emitter voltage of each ignition end stage transistor as long as a collector current of the ignition end stage transistor is below a given value.

3. The method according to claim 1, which comprises carrying out the step of measuring the value of the base-to-emitter voltage of each ignition end stage transistor as soon as a collector current of the ignition end stage transistor attains a given value.

4. The method according to claim 1, which comprises initiating the step of measuring the value of the base-to-emitter voltage of one of the ignition end stage transistors at the onset of a control signal for that transistor.

5. In an ignition device of an externally ignited internal combustion engine including at least two primary current circuits each having one ignition end stage transistor with base and emitter terminals; and secondary current circuits, an apparatus for monitoring the secondary current circuits, comprising an engine or ignition control unit for making said ignition end stage transistors conducting or nonconducting, said control unit having:

a measurement input connected to the base terminals of said ignition end stage transistors;

a measurement circuit connected to said measurement input for measuring values of successive base-to-emitter voltages of said ignition end stage transistors;

a memory connected to said measurement circuit for storing at least two successive measured values;

a comparison circuit connected to said memory for forming a difference value of the stored measured values; and at least one comparator connected to said comparison circuit for comparing the difference value with a predetermined limit value and for outputting a failure signal at an output if the difference value exceeds the limit value.

6. The apparatus according to claim 5, including means for decoupling the base terminals of said ignition end stage transistors from one another.

7. The apparatus according to claim 5, wherein said engine or ignition control unit is microprocessor-controlled.

8. In an ignition device of an externally ignited internal combustion engine including at least two primary current circuits each having one ignition end stage transistor with base and emitter terminals; and secondary current circuits, an apparatus for monitoring the secondary current circuits, comprising an engine or ignition control unit for making said ignition end stage transistors conducting or nonconducting, said control unit having:

a measurement input connected to the base terminals of said ignition end stage transistors;

a measurement circuit connected to said measurement input for measuring values of successive base-to-emitter voltages of said ignition end stage transistors;

a memory connected to said measurement circuit for storing at least two successive measured values;

a comparison circuit connected to said memory for forming a quotient of the stored measured values; and at least one comparator connected to said comparison circuit for comparing the quotient with an upper limit value and a lower limit value and for outputting a failure signal at an output if the quotient exceeds the upper limit value or fails to attain the lower limit value.

9. The apparatus according to claim 8, including means for decoupling the base terminals of said ignition end stage transistors from one another.

10. The apparatus according to claim 8, wherein said engine or ignition control unit is microprocessor-controlled.

* * * * *